US006357240B1

(12) United States Patent
Zugibe et al.

(10) Patent No.: US 6,357,240 B1
(45) Date of Patent: Mar. 19, 2002

(54) APPARATUS AND METHOD FOR FLUSHING A CHILLER SYSTEM

(75) Inventors: Kevin Zugibe, Pomona, NY (US); Arthur R. Mika, Baton Rouge, LA (US)

(73) Assignee: Hudson Technologies, Inc., Pearl River, NY (US)

( * ) Notice: Subject to any disclaimer, the term of this patent is extended or adjusted under 35 U.S.C. 154(b) by 0 days.

(21) Appl. No.: 09/373,300

(22) Filed: Aug. 12, 1999

Related U.S. Application Data

(60) Provisional application No. 60/096,294, filed on Aug. 12, 1998.

(51) Int. Cl.[7] ..... F25B 47/00; F25B 45/00

(52) U.S. Cl. ..... 62/85; 62/149; 62/292

(58) Field of Search ..... 62/77, 85, 149, 62/292

(56) References Cited

U.S. PATENT DOCUMENTS

| | | | | | |
|---|---|---|---|---|---|
| 2,951,349 | A | | 9/1960 | Etherington | |
| 4,261,178 | A | | 4/1981 | Cain | 62/149 |
| 4,285,206 | A | * | 8/1981 | Koser | 62/126 |
| 4,364,236 | A | | 12/1982 | Lower et al. | 62/77 |
| 4,441,330 | A | | 4/1984 | Lower et al. | 62/149 |
| 4,476,668 | A | | 10/1984 | Reilly | 56/202 |
| 4,539,817 | A | | 9/1985 | Staggs et al. | 62/149 |
| 4,768,347 | A | | 9/1988 | Manz et al. | 62/149 |
| 4,939,905 | A | | 7/1990 | Manz | 62/77 |
| 4,942,741 | A | * | 7/1990 | Hancock et al. | 62/292 |
| 5,032,148 | A | | 7/1991 | Baker et al. | 55/16 |
| 5,044,166 | A | | 9/1991 | Wijmans et al. | 62/85 |
| 5,089,033 | A | | 2/1992 | Wijmans | 55/16 |
| 5,110,364 | A | | 5/1992 | Mazur et al. | 134/2 |
| 5,167,126 | A | | 12/1992 | Cartwright | 62/129 |
| 5,176,008 | A | | 1/1993 | Van Steenburgh | 62/292 |
| 5,189,889 | A | | 3/1993 | Daily | 62/292 |
| 5,195,333 | A | | 3/1993 | Van Steenburgh | 62/292 |
| 5,199,962 | A | | 4/1993 | Wijmans | 55/16 |
| 5,200,431 | A | | 4/1993 | Dattani et al. | 570/178 |
| 5,205,843 | A | | 4/1993 | Kaschemekat et al. | 55/16 |
| 5,222,369 | A | | 6/1993 | Hancock et al. | 62/149 |
| 5,226,300 | A | * | 7/1993 | Christensen et al. | 62/77 |
| 5,231,841 | A | | 8/1993 | McClelland et al. | 62/66 |
| 5,231,980 | A | | 8/1993 | Filipovic et al. | 128/205.12 |
| 5,243,831 | A | | 9/1993 | Major et al. | 62/292 |
| 5,245,840 | A | | 9/1993 | Van Steenburgh | 62/292 |
| 5,263,331 | A | | 11/1993 | Sergius | 62/77 |
| 5,269,155 | A | | 12/1993 | Adelmann | 62/292 |
| 5,272,882 | A | | 12/1993 | Degier et al. | 62/77 |
| 5,277,032 | A | | 1/1994 | See et al. | 62/125 |
| 5,313,808 | A | | 5/1994 | Scuderi | 62/475 |
| 5,327,735 | A | | 7/1994 | Hatton | 62/292 |
| 5,347,822 | A | | 9/1994 | Lavin et al. | 62/85 |
| 5,353,603 | A | | 10/1994 | Outlaw et al. | 62/149 |
| 5,359,859 | A | | 11/1994 | Bench et al. | 62/85 |
| 5,363,662 | A | * | 11/1994 | Todack | 62/85 |
| 5,371,019 | A | | 12/1994 | Manz et al. | 436/126 |
| 5,374,300 | A | | 12/1994 | Kaschemekat et al. | 95/39 |
| 5,377,499 | A | | 1/1995 | Zugibe | 62/195 |
| 5,379,607 | A | | 1/1995 | Sergius | 62/126 |
| 5,390,503 | A | | 2/1995 | Cheng | 62/125 |
| 5,425,242 | A | | 6/1995 | Dunne et al. | 62/85 |

(List continued on next page.)

*Primary Examiner*—William C. Doerrler
(74) *Attorney, Agent, or Firm*—Milde, Hoffberg & Macklin, LLP

(57) ABSTRACT

A method for flushing contaminants from a contaminated refrigeration system, comprising flushing a continuously purified volatile composition through a portion of a refrigeration system during a first phase; flushing an aqueous solvent through the portion of the refrigeration system during a second phase; and drying the portion of the refrigeration system to remove residual water. The source of purified volatile composition preferably employs a recycling or in-line purification system, for example, a fractional distillation system. The preferred volatile composition is R-22.

22 Claims, 2 Drawing Sheets

U.S. PATENT DOCUMENTS

| | | | | |
|---|---|---|---|---|
| 5,442,930 | A | | 8/1995 | Stieferman ..... 62/85 |
| 5,444,171 | A | | 8/1995 | Ohno et al. ..... 570/177 |
| 5,446,216 | A | | 8/1995 | Rao ..... 570/151 |
| 5,456,841 | A | | 10/1995 | Lee ..... 210/640 |
| 5,469,714 | A | | 11/1995 | Manz et al. ..... 62/125 |
| 5,470,442 | A | | 11/1995 | Mahler et al. ..... 203/506 |
| 5,497,627 | A | | 3/1996 | Heyduk et al. ..... 62/85 |
| 5,502,974 | A | | 4/1996 | Zugibe ..... 62/77 |
| 5,514,595 | A | | 5/1996 | Olds et al. ..... 436/126 |
| 5,534,151 | A | | 7/1996 | Lee ..... 210/640 |
| 5,616,821 | A | * | 4/1997 | Mouk et al. ..... 570/177 |
| 5,709,091 | A | | 1/1998 | Todack ..... 62/85 |

* cited by examiner

APPARATUS AND METHOD FOR FLUSHING A CHILLER SYSTEM

The present application claims the benefit of priority from U.S. Provisional Patent Application Ser. No. 60/096,294 filed on Aug. 12, 1998.

FIELD OF THE INVENTION

The present invention relates to the field of water chiller cleaning systems, and more particularly to a system for flushing and recharging a refrigeration system water chiller, especially after contamination.

BACKGROUND OF THE INVENTION

Mechanical refrigeration systems are well known. Their applications include refrigeration, heat pumps, and air conditioners used both in vehicles and in buildings. The vast majority of mechanical refrigeration systems operate according to similar, well known principles, employing a closed-loop fluid circuit through which refrigerant flows, with a source of mechanical energy, typically a compressor, providing the motive forces.

Typical refrigerants are substances that have a boiling point below the desired cooling temperature, and therefore absorb heat from the environment while evaporating under operational conditions. Thus, the environment is cooled, while heat is transferred to another location where the latent heat of vaporization is shed. Refrigerants thus absorb heat via evaporation from one area and reject it via condensation into another area. In many types of systems, a desirable refrigerant provides an evaporator pressure as high as possible and, simultaneously, a condenser pressure as low as possible. High evaporator pressures imply high vapor densities, and thus a greater system heat transfer capacity for a given compressor. However, the efficiency at the higher pressures is lower, especially as the condenser pressure approaches the critical pressure of the refrigerant. It has generally been found that the maximum efficiency of a theoretical vapor compression cycle is achieved by fluids with low vapor heat capacity, associated with fluids with simple molecular structure and low molecular weight.

Refrigerants must satisfy a number of other requirements as best as possible including: compatibility with compressor lubricants and the materials of construction of refrigerating equipment, toxicity, environmental effects, cost availability, and safety.

The fluid refrigerants commonly used today typically include halogenated and partially halogenated alkanes, including chlorofluorocarbons (CFCs), hydrochlorofluorocarbons (HFCFs), and less commonly hydrofluorocarbons (HFCs) and perfluorocarbons (PFCs). A number of other refrigerants are known, including propane and fluorocarbon ethers. Some common refrigerants are identified as R11, R12, R22, R500, and R502, each refrigerant having characteristics that make them suitable for different types of applications.

For example, R22 is of particular interest in that it is commonly used in commercial air conditioning systems, which often must be purged to conduct repairs. This R22 is collected in transfer vessels, also known as recovery cylinders, which hold about 30–50 pounds of refrigerant. This refrigerant is generally mixed with compressor lubricant oil, and may be contaminated with water, grit, or other materials. The transportation and logistics of recycling contaminated or used refrigerants typically compel careful use and disposition. Therefore, the art teaches that intentional contamination of refrigerants be strictly avoided, in order to reduce the amounts of refrigerants which must be purified. International treaties and regulations generally ban the disposal of refrigerant.

The mechanical compressor is subjected to operational stresses, and is subject to failure. Typically, the compressor is hermetically sealed within the refrigeration system, and failure of the compressor leads to high temperatures; burning and electrical arcing. These result in contamination of the refrigerant within the hermetically sealed space. Another mode of refrigeration system failure is breach of the hermetic seal, which may occur by accident, corrosion, or other cause. Often, this breach allows external environmental contaminants to enter the refrigeration system, also resulting in contamination.

During usage, it is important that the refrigerants be kept relatively free of contaminants, including foreign matter such as particulates, water and air, which may reduce system efficiency and/or cause wear or system failure. It is vital that hermetic integrity of the refrigerant system be maintained, both to retain the refrigerants and to prevent influx of undesired elements. When the refrigerants become contaminated, though influx of undesired elements, breakdown of refrigerant components, or internal contamination, such as by failure of a compressor motor, it becomes necessary to replace or purify the refrigerants, and often to completely clean the refrigeration system.

Contaminants within a refrigerant are thus substances that render the refrigerant impure. They include gaseous substances such as non-condensables, liquids such as water and solid particulates such as metal fillings. Contaminants also include chloride ions, acids, salts, and various other residues that result when hermetically sealed compressor motors fail while electrically charged, often with burned wire insulation. Contamination is generally measured via various laboratory instruments. Air conditioning/refrigeration original equipment manufacturers and standards organizations specify the percent of contamination allowable within equipment.

Another mode of failure of a refrigeration system, especially in a commercial chiller system, is a rupture or failure of a refrigerant-water heat exchanger. In this case, the refrigerant (with refrigerant oil) and water become mixed, contaminating both the primary and secondary heat exchange systems. The aqueous phase in a chiller is typically impure, and may have mineral salts and organic compounds as scale inhibitors, as well as scale. The solution may include, for example, calcium chloride brine. Thus, merely drying the system after such a failure is insufficient to repair the damage, as aqueous contaminants will remain in the refrigeration system, and nonvolatile refrigerant oil will remain in the water space. Further, even without hermetic failure of the chiller, the aqueous heat exchange system is subject to scale buildup, which reduces heat exchange efficiency, resulting in a need for periodic maintenance. Mechanical refrigeration systems thus periodically require servicing, either due to failure or for preventive maintenance. This servicing often includes the addition of refrigerant into the system to replace refrigerant which has escaped from the system. Other servicing often takes the form of repairs to, or replacements of components in the system such as compressors, evaporators, filters, dryers, expansion valves and condensers.

Before adding refrigerant, or repairing or replacing one or more components, it is often necessary to remove the refrigerant remaining in the system. Typically, this remaining refrigerant is removed and stored in transfer vessels. To avoid releasing these fluorocarbons into the atmosphere, devices have been constructed that are designed to recover the refrigerant from the refrigeration system. Examples of such a refrigerant recovery devices are shown in U.S. Pat. Nos. 4,942,741; 4,285,206; 4,539,817; 4,364,236; 4,441,330; 4,476,668; 4,768,347; and 4,261,178.

In this case, the refrigerant is normally transported to a recycler or reclaimer, who purifies the refrigerant for reuse. In this case, new refrigerant is used to charge the system when the repair is completed. Since refrigerant recycling is expensive, any cleaning or flushing of the system must be performed with disposable liquids, such as water or aqueous solutions, after the refrigerant is purged and before the refrigeration system is recharged.

It is believed that refrigerants, especially chlorofluorocarbons (CFCs), used in vapor compression cooling systems (i.e., refrigeration systems) have a detrimental effect on the ozone layer of the earth's atmosphere when released from the refrigeration system into the environment. To this end, Federal legislation has been exacted, commonly referred to as the Clean Air Act, that has mandated strict requirements directed toward eliminating the release of CFCs into the atmosphere. In fact, after Jul. 1, 1992 Federal Law make it unlawful for any person in the course of maintaining, servicing, repairing and disposing of air conditioning or refrigeration equipment, to knowingly vent or otherwise release or dispose of ozone depleting substances used as refrigerants, and imposes stiff fines and penalties will be levied against violators.

The refrigerant management business is thus subject to extensive, stringent and frequently changing federal, state and local laws and substantial regulation under these laws by governmental agencies, including the EPA, the United States Occupational Safety and Health Administration and the United States Department of Transportation. Among other things, these regulatory authorities impose requirements which regulate the handling, packaging, labeling, transportation and disposal of hazardous and nonhazardous materials and the health and safety of workers.

Pursuant to the Clean Air Act, a recovered refrigerant must satisfy the same purity standards as newly manufactured refrigerants in accordance with standards established by the Air Conditioning and Refrigeration Institute ("ARI") prior to resale to a person other than the owner of the equipment from which it was recovered. The ARI and the EPA administer certification programs pursuant to which applicants are certified to reclaim refrigerants in compliance with ARI standards. Under such programs, the ARI issues a certification for each refrigerant and conducts periodic inspections and quality testing of reclaimed refrigerants.

The ARI standards define a level of quality for new and reclaimed refrigerants which can be used in new or existing refrigeration and air-conditioning equipment. The standard is intended to provide guidance to the industry, including manufacturers, refrigerant reclaimers, and the like. Contaminated or substandard refrigerant can result in the failure of refrigeration system components such as the compressor, or poor system efficiency.

The increasing cost of CFC and other refrigerants and the prohibition against environmental release have limited possibilities for thorough flushing of refrigeration systems with refrigerant or refrigerant-like compositions. Therefore, systems, even after repair may remain contaminated, or have suboptimal efficiency.

U.S. Pat. No. 5,377,499, expressly incorporated herein by reference, provides a portable device for refrigerant reclamation. In this system, refrigerant may be purified on site, rather than requiring, in each instance, transporting of the refrigerant to a recycling facility.

In general terms, recycling equipment collects and reuses the refrigerant of a refrigeration system that has broken down and is need of repair or one that simply requires routine maintenance involving the removal of refrigerant. However, it should be noted that the terms "recover," "recycle" and "reclaim" have significantly distinct definitions in the art and that each definition connotes specific performance characteristics of a particular piece of recycling equipment. "Recover" means removing refrigerant, in any condition, from a system and storing it in an external container without necessarily testing or processing it in any way. Recovery processes are well known, and often the refrigerant is recovered during system repair and used to recharge the source system after repair. Thus, where for some reason the source system is not immediately recharged, the recovered refrigerant, which is often not particularly contaminated, is removed. "Recycle" means to clean recovered refrigerant for reuse by separating moisture and oil and making single or multiple passes through devices, such as replaceable core filter-dryers, which reduce moisture, acidity and particulate matter that have contaminated the refrigerant. A recycling system does not seek to separate mixed refrigerants or to assure product purity. Finally, "reclaim" means to reprocess the recovered and/or recycled refrigerants to new product specifications by means which may include distillation. Chemical analysis of the refrigerant is typically required to determine that appropriate product specifications are met. Thus, the term "reclaim" usually implies the use of processes or procedures available only at a reprocessing or manufacturing facility. However, portable reclamation systems are available.

There are a number of known methods and apparatus for separating refrigerants, including U.S. Pat. Nos. 2,951,349; 4,939,905; 5,089,033; 5,110,364; 5,199,962; 5,200,431; 5,205,843; 5,269,155; 5,347,822; 5,374,300; 5,425,242; 5,444,171; 5,446,216; 5,456,841; 5,470,442; and 5,534,151. In addition, there are a number of known refrigerant recovery systems, including U.S. Pat. Nos. 5,032,148; 5,044,166; 5,167,126; 5,176,008; 5,189,889; 5,195,333; 5,205,843; 5,222,369; 5,226,300; 5,231,980; 5,243,831; 5,245,840; 5,263,331; 5,272,882; 5,277,032; 5,313,808; 5,327,735; 5,347,822; 5,353,603; 5,359,859; 5,363,662; 5,371,019; 5,379,607; 5,390,503; 5,442,930; 5,456,841; 5,470,442; 5,497,627; 5,502,974; and 5,514,595. Also known are refrigerant property analyzing systems, as shown in U.S. Pat. Nos. 5,371,019; 5,469,714; and 5,514,595.

Thus, there is a need for an apparatus and method for providing quantities of refrigerant for flushing refrigeration systems without producing corresponding quantities of contaminated refrigerant that must be remotely processed. There is also a need for a system and method that allows efficient cleansing of a refrigeration system during repair or maintenance.

SUMMARY OF THE INVENTION

The present invention therefore provides a system and method for cleaning and descaling refrigeration chillers, including a system for in-line purification of flush solutions comprising a volatile composition, allowing a refrigeration system to be sequentially flushed with a volatile composition, such as the normal refrigerant or other refrigerant-like composition, and an aqueous composition, without generating large quantities of contaminated refrigerant for transport and remote recycling.

The present invention also provides a system that allows a cleansing sequence to be established to manually or automatically institute a flush cycle in a refrigeration chiller system, to clean components and improve system efficiency. In particular, during use, the aqueous solution in a refrigeration heat exchanger used to isolate the refrigerant evaporator from the process. This aqueous solution is typically a brine, having a freezing point well below 0° C. This brine may be corrosive and, if it contaminates the refrigeration system, such as through an isolation breach in the evaporator, may result in the need for a complete shutdown and repair, with contamination of the normally clean refrigerant tubes with crystallized salts. These deposits directly impedes heat transfer and results in reduced heat exchanger efficiency. Further, the contamination may result in reduced compressor life and corrosion. In order to restore system efficiency, these deposits must be removed.

Even in the absence of failure, scale may build up in the heat exchanger, but typically on the aqueous side of the system. This scale may be due to exhaustion of scale inhibitors, corrosion, or crystallization of minor ions.

According to prior methods, the heat exchanger was flushed with an aqueous cleaning solution until the scale was removed. This was problematic, however, where a physical barrier limited access by the aqueous solution to the deposits. For example, oils and other hydrophobic deposits cover and protect the mineral scale, thus limiting the effectiveness of an aqueous flush. Further, through breakdown and oxidation, organic deposits may occur.

According to the present invention, a refrigeration system, (after repair if necessary to obtain hermeticity,) is flushed with a continuous stream of a refrigerant or refrigerant-like (volatile at ambient temperature and non-corrosive) composition. Preferably, the volatile flush is the design refrigerant of the system. This provides a number of benefits, including avoiding an analysis of each system component of a legacy system to determine sensitivity to alternate flush components, and facilitates restarting of the system after the flush cycle is complete.

In order to clean a large system, various system segments may be individually flushed. Thus, the evaporator, condenser, and compressor may be separately flushed. Therefore, the flush may be optimized for these system segments. In particular, the compressor typically requires a lubricant for extended operation under normal cycle conditions. However, the addition of a lubricant to a flush stream poses difficulties. The large flush volume would require a large amount of lubricant. Using an oil separator to recycle lubricant risks recontaminating the compressor. Further, an additional feed line for lubricant would be required and the capacity opf the recycling system for non-volatile liquids would have to be increased. Therefore, the compressor, if not new or completely refurbished, is preferably flushed with little or no lubricant. In order to avoid damage, the compressor is operated with little or no back pressure, and may be cycled intermittently. Of course, bearing in mind the, added complexity, and issues involving recycling or disposal of compressor oil, lubricant may be added to the flush stream in the compressor.

The preferred system for in-line purification of refrigerant is the so-called "Zugibeast®", described in U.S. Pat. No. 5,377,499, incorporated herein by reference. However, other or additional purification systems may also be employed as known in the art. For example, U.S. Pat. No. 5,709,091, expressly incorporated herein by reference, also discloses a refrigerant recycling method and apparatus.

Advantageously, the received contaminated refrigerant is fed into a fractional distillation chamber controlled to be at a temperature below its boiling point, and therefore condenses into a bulk of liquid refrigerant remaining within the vessel. Since the refrigerant used in the flush cycle is not employed to remove heat from the process, the amount of cooling necessary to drop the refrigerant below its boiling point (at the particular containment pressure) will approximately equal the heat absorbed from the environment plus any inefficiencies in the system, a relatively modest amount in most cases. The distillation chamber has a controlled temperature, and thus the more volatile fractions will tend to vaporize, leaving the bulk of refrigerant and less volatile fractions. The vapors above the pool of refrigerant are relatively pure, while most contaminants remain in the liquid phase. As the contaminants accumulate in the liquid phase, portions may be drawn off and stored. Fresh refrigerant may be added to replace the lost amounts. The refrigerant vapors are then subjected to a compressor. The compressed gasses are thus heated, and then cooled in a heat exchanger with the bulk of liquid refrigerant in the distillation chamber. This heat exchanger recondenses most of the compressed gas, while the liquid refrigerant is heated to compensate for the lost heat of vaporization of the purified refrigerant. Where the temperature of the distillation chamber rises too high, the compressed refrigerant gasses bypass the heat exchanger, thus effectively cooling the bulk of the liquid refrigerant due to the net loss of the heat of vaporization. The reliquified refrigerant is then subjected to an auxiliary compressor which sheds heat added, for example, by the primary compressor, and purified liquid refrigerant is available for further flushing of the system.

In addition to a fractional distillation system, other means may be employed to purify the refrigerant stream. For example, where particular impurities are known or suspected, these may be removed by means of particular filters or systems, such as membrane separation systems, and solid sorbents. For example certain zeolites and modified zeolites may be used to selectively remove compositions from a fluid stream, such as hydrocarbons, water, chlorinated compounds, etc. Since the flush recirculates a refrigerant stream, complete single pass sorption is not required, and therefore even low efficiency selective sorbents may be employed. Preferably, however, the refrigerant flush is purified, speeding the flush process and allowing accurate measurements of remaining impurities in the system.

While simple visual or manual confirmation of completion of a flush cycle is possible, the cycle may be automated. The typical impurities are water, ions, non-volatile organics, acid gasses, and breakdown products of refrigerants. Each of these constituents may be measured in the refrigerant flush stream, and the flush cycle terminated when all significant impurities are below a predetermined threshold.

In the case of an automated analyzer, the flush composition may be selectively altered to optimize removal of particular contaminants. For example, hydrophobic contaminants may be addressed with an aqueous flush phase. Solvents may be selectively mixed with the volatile composition, especially those which are efficiently separated in the purification apparatus and which are easily removed from the refrigeration system.

Thus, it is an object of the present invention to provide a system which may flush a refrigeration system with an improper refrigerant or otherwise abnormal stream, and thereafter recharge the system with an appropriate refrigerant.

In order to determine a type and quality of refrigerant, a qualitative analyzer may be employed. Preferably, this analyzer employs infrared (IR) refrigerant identification technology such as that developed by and available from DuPont/Neutronics, e.g., Refrigerant Identifier II™, Model 9552. Typically, these systems are not considered highly portable. Therefore, a portable analyzer system may be employed in its stead.

The sample under test enters the identifier via a pressure switch controlled solenoid valve. Oil, acids and other contaminates are removed in an internal, heated flash pot. Separated oils and contaminates are automatically flushed from the identifier into an external catch basin which accompanies the analyzer instrument. The catch basin is periodically emptied. The cleansed sample gas is regulated and passed through a coalescing filter, which further cleanses the sample of oils and particulates. The clean sample gas travels to the multiple detector Non-Dispersive InfraRed (NDIR) sensing device for analysis. Signals from the sensing device are fed into a microprocessor where the refrigerant type and purity are determined. Depending on the results of this analysis, the system may produce a displayed or printed output, or initiate a control sequence for the flush system.

In the case of an automated flush cycle, the master control for the system interacts with the qualitative analyzer to allow automation of the processes. Thus, the software of the qualitative analyzer need not be modified for integration into the flush system. Therefore, the various switches and outputs are interfaced with the master control rather than a human user interface. In addition, the master control may be used to maintain the qualitative analyzer in a state of readiness, i.e., warmed up and calibrated. In addition, the master control may provide ventilation to prevent the qualitative analyzer from becoming overheated, or selectively apply power to prolong component life, prevent overheating and reduce power consumption. In addition, the master control allows threshold determination separate from that included within the qualitative analyzer. Thus, the qualitative analyzer processor need not be employed to make decisions about whether the system is sufficiently cleansed; rather, these decisions may be made in the master control, and updated and adapted as appropriate. Of course, the qualitative analyzer may also be integrated with the system control.

In the case of the DuPont/Neutronics Refrigerant Identifier II™, Model 9552, the communication between the master control and the qualitative analyzer may be through the printer port, reconfigured human interface panel, or-through another interface, such as a serial port or diagnostics port, which is not normally employed during operation of the device.

Where a complex flush cycle is instituted, one or more transfer cylinders may be provided, containing initially a fresh supply of flush composition, and ultimately refilled to contain impure solution with the flushed contaminants. These transfer cylinders may then be transported for off-site refining.

In a preferred embodiment of the invention, the refrigeration system is initially flushed with purified refrigerant until all materials soluble or miscible with the refrigerant are removed. For example, refrigerant oil and hydrophobic substances are flushed from the system. In a second phase, an aqueous flush is instituted, seeking to remove all hydrophilic and water soluble components in the system. This aqueous flush may be hot water, or a water solution, for example, including chelators or scale inhibitors. For example, in the case of a failed brine chiller, salts, such as calcium chloride, are removed from the refrigeration system by the aqueous flush. Finally, the system is again flushed with refrigerant, to remove water, which is somewhat miscible with refrigerant, e.g., R-22. The resulting system is clean and dry and ready to be placed back in service.

It is noted that, where a secondary loop of a heat exchanger system is contaminated by refrigerant and oil, a process may be employed which initially flushes the aqueous portion of the system with refrigerant or another organic solvent which can be purified, and subsequently with an aqueous phase. In this case, this portion of the system need not be dried, and therefore a third flush cycle with refrigerant is not necessary. Further, since there is no "normal" design refrigerant, the selection of the volatile composition is based on convenience and functionality.

In particular, one preferred method according to the present invention provides a method and apparatus for sequentially flushing a cooling system of a refrigeration system, comprising a first flush cycle with a continuous stream of purified volatile composition into a refrigeration primary loop; flushing the stream of purified volatile composition through at least a portion of the refrigeration primary loop; and purifying the flushed stream of purified volatile composition for further use in flushing the refrigeration primary loop. A second flush cycle with an aqueous solvent in the refrigeration primary loop, and a third flush cycle equivalent to the first flush cycle.

The apparatus includes a coupler for introducing a purified purified volatile composition into a refrigeration primary loop, a coupler for receiving flushed volatile composition from the refrigeration primary loop, and a purification system for purifying flushed volatile composition. The apparatus also includes an aqueous solvent source, such as heated water, which need not be recycled, although a heat-exchanger may be used to recapture the heat energy. Finally, the system may optionally include a controller, for controlling the flush cycles.

In order to determine when the first flush cycle is complete, a nonvolatile residue in the flush stream is measured. This may be automatic or manual, for example as a mass or visual indication. When the residue is below a threshold, the first flush phase may be terminated. The second flush phase includes an aqueous solvent. If the solvent is relatively pure hot water, then a conductivity measurement may be used to determine when the flush cycle is complete. Otherwise, particular ion measurements, turbidity, or other known means may be used to determine when the system is sufficiently flushed. Finally, the third flush cycle is primarily to remove water from the system, which should be very dry for normal operation. Since the purpose of the third cycle is drying the system it is understood that other known drying sequences may be employed after the system is flushed clean. However, the use of refrigerant. e.g., R-22, is particularly advantageous because of its high speed and ease of placing the system back into operation.

In one embodiment, the purified volatile composition is the normal refrigerant of the refrigeration primary loop, with or without a refrigeration oil. For example, when the purified volatile composition is flushed through an operational refrigeration system, an appropriate oil or lubricant is added to the purified volatile composition in order to maintain ordinary operational parameters and to reduce compressor wear. The refrigerant oil may be recycled through the purification system, or replenished from an external source. The refrigerant oil component need not be the normal lubricant, and may, for example, have higher detergency or be present in lower concentrations. When the flush cycle is completed, the lubrication is properly adjusted.

These and other objects will become apparent. For a full understanding of the present invention, reference should now be made to the following detailed description of the preferred embodiments of the invention as illustrated in the accompanying drawings.

BRIEF DESCRIPTION OF THE DRAWINGS:

The invention will now be described with reference to the accompanying drawings, in which.

DETAILED DESCRIPTION OF THE PREFERRED EMBODIMENTS

Figure 1:
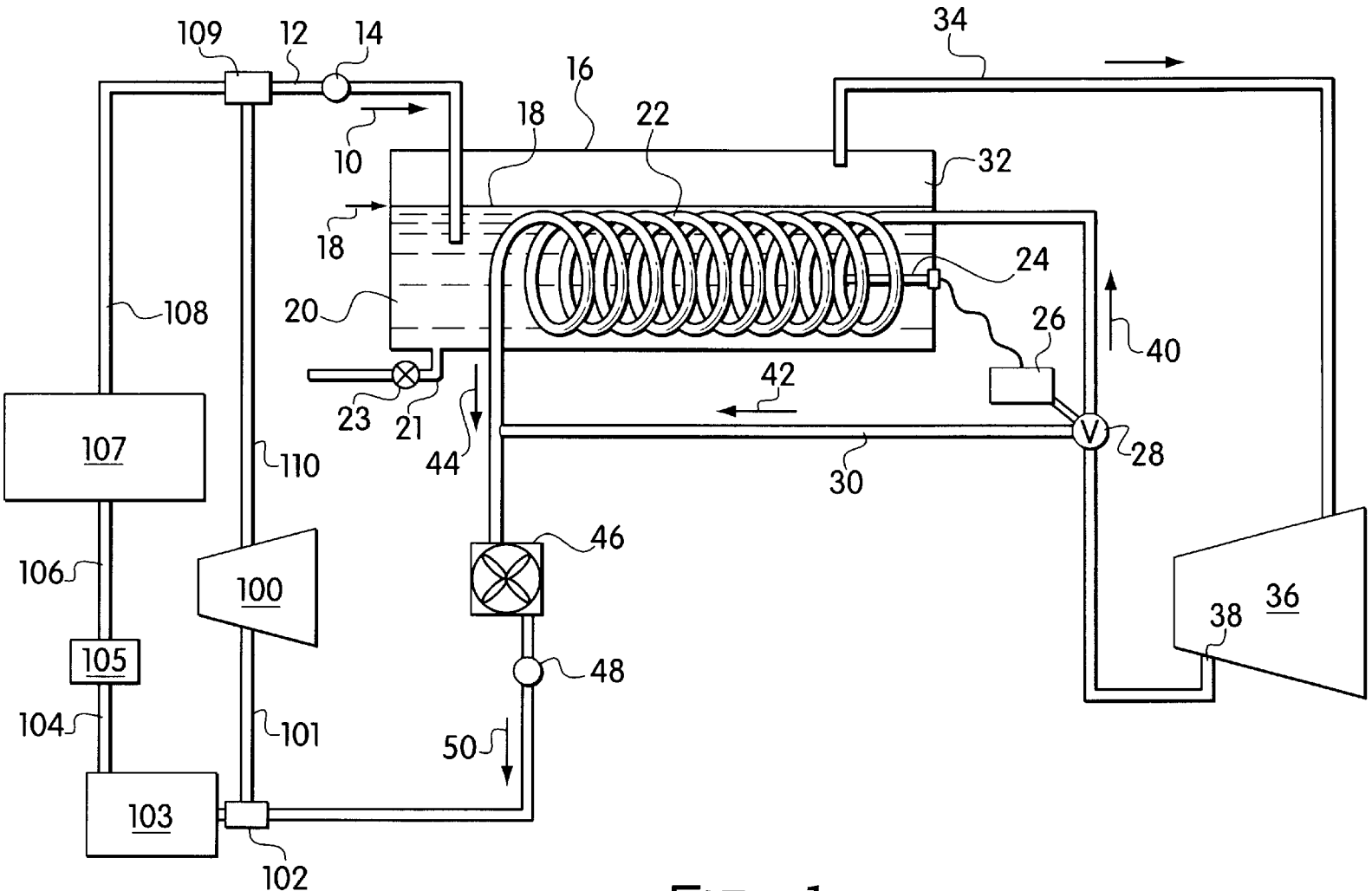
FIG. 1 is a diagram of the refrigeration flush system according to the present invention.

The detailed preferred embodiments of the invention will now be described with respect to the drawings. Like features of the drawings are indicated with the same reference numerals.

A tube-to-tube-sheet joint in an evaporator of an industrial process chiller leaked, causing the chiller to became contaminated with calcium chloride brine. Salt from the brine crystallized in the chiller's piping and restricted refrigerant flow. The brine also caused corrosion, which added more contaminants, and water from the brine combined with oil to create agglomerates.

To complete the job as quickly as possible, work went on around the clock. The process began with flushing the chiller with refrigerant, then the salt was cleared out with hot water, followed by drying with refrigerant. In the final step of the process, the chiller was tested for leaks under vacuum and then recharged.

A key factor in the cleanup process was Hudson's patented Zugibeast® refrigerant recovery and reclamation system. This portable device recovers and cleans refrigerant to ARI 700 standards at up to 6,000 lb/hr, removing water, oil, acids, sludge, and particulates. Although not required in this case, the Zugibeast® can be put in line with an operating chiller to clean the system without a shutdown.

During the first decontamination step, the DuPont Freon® 22 (R-22) refrigerant in the chiller was circulated out through the Zugibeast® for reclamation and back through the chiller to remove as much contamination and oil as possible. To help ensure thorough cleaning, major chiller components were disconnected and treated separately. After 24 hours, the refrigerant exiting from the chiller components was clean and circulation was halted. The refrigerant was evacuated through the Zugibeast® and stored for reuse.

The second step was to remove calcium chloride from the chiller. Calcium chloride isn't soluble in Freon® 22, so it remained after the first step. One known approach for removing salt would have been to disassemble the components for manual cleaning. However, this known approach would have required cutting and rejoining of welded connections and painstaking scraping and brushing, which is time consuming and manual labor intensive.

Therefore, the present invention provides for the removal of salts by dissolution in an aqueous solvent, particularly hot water. While other solvents or solvent systems may be used, these may raise concerns about solvent compatibility with materials used in the chiller. Normally, aqueous flush cycles are limited to small chillers, because large chillers are subject to corrosion and other water damage from exposure to aqueous solvent systems. However, according to the present invention, rapid drying can be achieved, lessening the risk of water damage.

The compressor's lubricating system, including the bearings and coalescing filter, was excluded from the aqueous phase solvent by piping the water around it.

To increase the flow for faster cleaning, orifices and strainers were removed and the expansion valve was bypassed. A header distributed water to the components, while centrifugal pumps were used at the input and output. To capture solid material, 100-micron bag filters were installed in the water system.

After about 48 hours, analysis showed that the cleaning water was free of salt. The chiller was then ready for drying.

Often, water is removed from refrigeration systems by putting them under vacuum. However, this could have kept the chiller off line for as long as three weeks, more time than was available for the project. Purging with hot nitrogen, another drying technique, would also have required too much time.

According to one aspect of the invention, the chiller was dried by exploiting the affinity of Freon® 22 for water. The chiller was charged and, as in the initial flushing, the reclaimed refrigerant was circulated through the chiller and the Zugibeast®, which removed the water. Hot refrigerant vapor was used at first followed by liquid refrigerant. Water droplets on the sight glass visibly shrank and disappeared as refrigerant vapor washed over them.

Drying was monitored on line with a digital moisture meter installed in a refrigerant line. After 48 hours, the moisture level was on target and the refrigerant was removed. The chiller was pumped down and held under vacuum as a final test. Then it was recharged and placed back in service. The chiller was then available for operation as needed at its rated capacity.

It is important during a drying cycle to exercise mechanical components of the system, such as valves, which may retain water. Thus, in contrast to oil-soluble contaminants, which generally are nor problematic in small concentrations, water droplets caught in crevices are sufficient to cause damage to the system. Thus, check valves, solenoid valves and the like are exercised, and the main compressor rotated, to ensure that pockets of water due not remain. Since the solubility of water in refrigerant, e.g., R-22, is limited, these actuations and repositionings must be performed a number of times during the flush cycle to ensure complete system drying. Mechanical elements may also be bypassed during the drying cycle, and dried separately.

As shown in FIG. 1, a refrigerant recovery system provides an inlet 12 for receiving contaminated refrigerant, a purification system employing a controlled distillation process, and an outlet 50 for returning purified refrigerant. This portion of the system is similar to the system described in U.S. Pat. No. 5,377,499, expressly incorporated herein by reference.

Typically, the compressor 100 is maintained outside the flush loop by isolation valves 102, 109, in order to avoid the need for lubrication oil in the flush stream. However, this is not a limitation on the apparatus or method, and for limited periods the compressor may be operated with no lubricant, with a sub-normal amount of lubricant, with an alternate lubricant, or with the normal lubricant in the normal concentrations. Further, the distillation apparatus may be operated in-line with the refrigeraion system, for example between the outlet line 101 of the compressor 100 and the isolation valve 102. A distillation apparatus may thus be provided to purify refrigerant received from a flush cycle. As shown, a fitting 14 receives the flow of refrigerant contents from the evaporator 107 of the refrigeration system, though line. 108. In this case, the purification system bypasses the compressor 100, and thus (a) this method is most appropriate after a compressor replacement and (b) no lubricant or oil is necessary during the flush cycle, thus simplifying purification and preparation of the flush solution.

Where the compressor 100 is not recently repaired or replaced, then it may be flushed as well, although during extended periods of operation a lubricant is necessary. This may be, for example, added to the purified refrigerant at the exit of the purification system. The compressor 100 itself may be short-cycled, and separately flushed from the evaporator and condenser, with low back pressure.

The refrigerant from the purification system is received by the condenser 103 through the isolation valve 102. Refrigerant flush then passes through the flow restrictor 105, which may be bypassed to increase the flow rate, to the evaporator 107. The refrigerant from the evaporator returns to the purification apparatus through line 108 via isolation valve 109.

As may be seen, the preferred embodiment of the present invention method and apparatus is capable of boiling contaminated refrigerant in a distillation chamber 30 without the need for external electrical heaters. Furthermore, the apparatus and method provide for condensing the compressed refrigerant vapor without cooling water, and can control the distillation temperature by throttling the refrigerant vapor.

The distillation is accomplished by feeding contaminated refrigerant, represented by directional arrow 10, through an inlet 12 and a pressure regulating valve 14. The contaminated refrigerant flows into distillation chamber, generally designated 16, to establish liquid level 18 of contaminated refrigerant liquid 20. A contaminated liquid drain 21 is also provided, with valve 23. Helical coil 22 is immersed beneath the level 18 of contaminated refrigerant liquid, and thermocouple 24 is placed at or near the center of coil 22 for measuring distillation temperature for purposes of temperature control unit 26. In turn, the temperature control unit controls the position of three-way valve 28, so that the distillation temperature will be set at a constant value at approximately 30 degrees Fahrenheit (for R22 refrigerant). Temperature control valve 28 operates in a manner, with bypass conduit .30, so that, as vapor is collected in the portion 32 of distillation chamber 16 above liquid level 18, it will feed through conduit 34 to compressor 36. This creates a hot gas discharge at the output 38 of compressor 36, such that those hot gases feed through three-way valve 28, under the control of temperature control 26. In those situations where thermocouple 24 indicates a distillation temperature above thirty degrees Fahrenheit, as an example, bypass conduit 30 will receive some flow of hot gases from compressor 36. Conversely, in those situations where thermocouple 24 indicates a temperature below thirty degrees Fahrenheit, as an example, the flow of hot gases will proceed as indicated by arrow 40 into helical coil 22.

It may also be seen from the drawing and this description, that when thermometer 24 indicates certain values of temperature near thirty degrees Fahrenheit, as an example, hot gases from the compressor will flow partially along the bypass conduit and partially into the helical coil to maintain the thirty degree temperature. It should be understood that for differing refrigerants or mixtures, the desired boiling temperature may vary, and thus the temperature may be controlled accordingly. In all situations, all flow through bypass conduit 30 and from helical coil 22, in directions 42, 44, respectively, will pass through auxiliary condenser 46 and pressure regulating valve 48 to produce a distilled refrigerant outlet indicated by directional arrow 50. Alternatively, condenser 46 is controlled by an additional temperature control unit, controlled by the condenser output temperature.

Figure 2A:
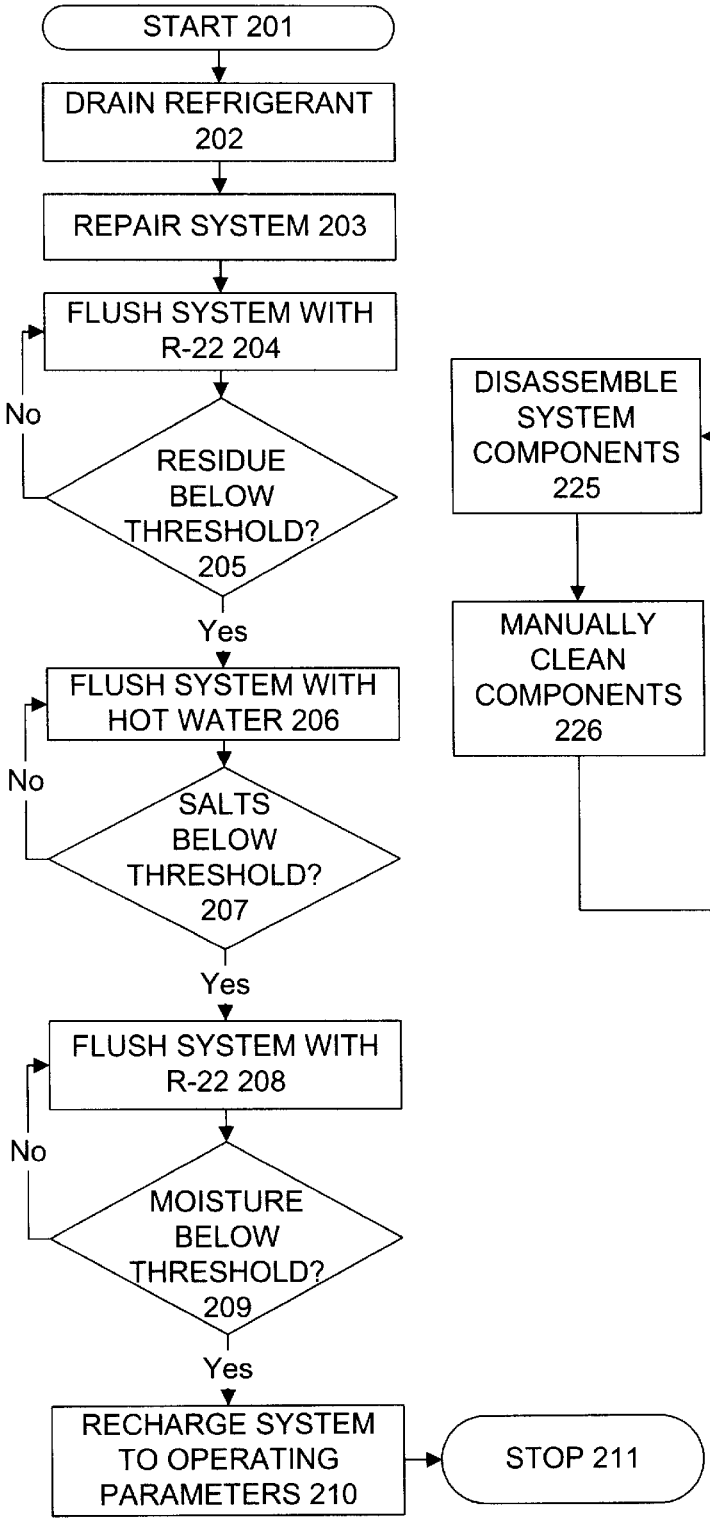
FIGS. 2A and 2B are show flow diagrams for a prior art method and the method according to the present invention for cleaning a contaminated refrigeration system.
Figure 2B:
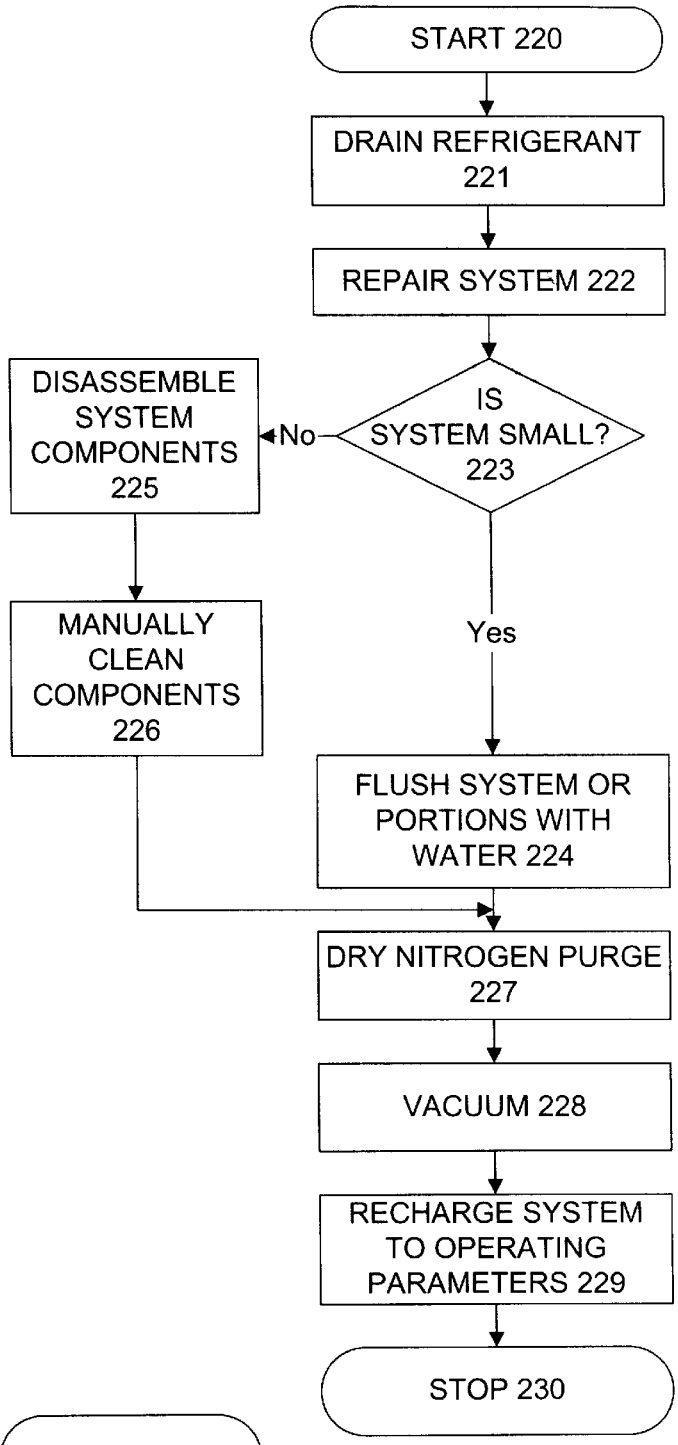

As shown in FIGS. 2A and 2B, the first step after starting 201, 220 is draining the system of refrigerant 202, 221, and then repairing any damage 203, 222. According to the prior art, if the system is small 223, portions may be flushed with water 224 to remove contaminants. Otherwise, the system is disassembled 225 and manually cleaned 226. In order to dry the system, a dry nitrogen purge is employed 227, and the nitrogen removed under vacuum 228. The system is recharged to operational parameters 229.

According to the present invention, the system is initially flushed with refrigerant R-22 204 until residue in the flush falls below a threshold 205. The system is then flushed with hot water 206 until salts in the water stream fall below a threshold 207. The moisture from the water flush is removed by a flush with R-22 refrigerant until moisture in the flush falls below a threshold 209. The system is recharged to operational parameters 210. Typically, before the recharge 210, 229, the system is tested under vacuum for leaks. This is especially so where components of the system are bypassed or reconfigured for the repair or flush process, and therefore fittings, connectors and gaskets are disturbed.

Thus, in a relatively compact volume and with modest energy requirements, distillation temperature control enables the vapor in the distillation chamber of the present invention to be used for heating of the contaminated liquid, by means of helical coil 22, to produce more vapor and further hot gas output from a compressor to continue the process according to the present invention. External electrical heaters are not necessary and enough condensing of the refrigerant vapor takes place in the distillation chamber of the present invention to require only a small, air or water-cooled auxiliary condenser 46 to dissipate heat from the work of compressor 36, which includes an oil separator. Air or water cooled condensers to condense the refrigerant are accordingly unnecessary. It is understood that the purified refrigerant is present in the gas phase of the distillation chamber, and will be recondensed by the auxiliary condenser 46. After this auxiliary condenser 46, the lower boiling point components (non-condensables) may be withdrawn through a purge unit.

By using the purification apparatus system of the present invention, refrigerant can be reclaimed at from approximately eighteen to one hundred thousand pounds in an eight hour work day, as distinguished from the prior art capacity of about fifteen hundred pounds per eight hour work day.

As will be noted, since the operational temperatures of the purification system are maintained at relatively low temperatures, the volatilization of contaminant compositions in the impure refrigerant is suppressed. Volatile compounds may also be selectively removed by, for example, sorption on solid sorbents, membrane filters, and/or liquid countercurrent redistribution. The high throughput of the purification system potentially allows a large number of turnovers of refrigerant in the refrigeration system, for example, 100 or more turnovers. Therefore, even a relatively low extraction ratio will result in eventual cleansing of the system. Further, the present preferred technique allows use of the native refrigerant, thus reducing risk of incompatability with the system materials.

The contaminated refrigerant is tested with a gas analyzer which determines the water content, acid content, refrigerant breakdown products, etc. Each detected contaminant is subjected to a threshold, and subtotal and total contaminants are also calculated. When the flush stream falls below all required contamination thresholds, the system may be considered clean, and the flush cycle ceased. It is noted that, since the flush stream is relatively rapid, the flush will not reach equilibrium with the contaminants in the system; therefore, the actual contamination levels will likely exceed the detected contamination in the flush. Therefore, a predictive algorithm is preferably employed to anticipate or predict the equilibrium contamination conditions with normal refrigerant and lubricant, based on, for example, the rate of flush, partition coefficients, characteristics of the refrigeration system, and the characteristics of the contaminants. Typically, the flush may continue long after the contaminants are removed, for example by running the flush overnight. However, this is not necessary. Accordingly, the qualitative analyzer provides contamination level data to the control system, which calculates the state of contamination of the refrigeration system, and on that basis, controls the flush cycle. The controlled parameters of the flush cycle may include, for example, the duration, flow rate, flush composition, including volatile composition, oil, detergent, abrasive, buffer or acid neutralizer, hydrophilic composition, etc.

There has thus been shown and described novel refrigeration flush systems and methods which fulfill all the objects and advantages sought therefor. Many changes, modifications, variations, combinations, subcombinations and other uses and applications of the subject invention will, however, become apparent to those skilled in the art after considering this specification and the accompanying drawings which disclose the preferred embodiments thereof. All such changes, modifications, variations and other uses and applications which do not depart the spirit and scope of the invention are deemed to be covered by the invention, which is to be limited only by the claims which follow.

What is claimed is:

1. A method for flushing contaminants from a contaminated refrigeration system, comprising:

(a) flushing a continuously purified volatile composition through a portion of a refrigeration system during a first phase;

(b) flushing an aqueous solvent through the portion of the refrigeration system during a second phase; and (c) drying the portion of the refrigeration system to remove residual water.

2. The method according to claim 1, wherein said flushing a continuously purified volatile composition step comprises providing a source of purified volatile composition to the portion of the refrigerant system; passing the purified volatile composition through the portion of the refrigerant system; receiving the volatile composition from the portion of the refrigerant system; and purifying the volatile composition by separation of contaminants therefrom.

3. The method according to claim 1, wherein said purification step comprises a fractional distillation of volatile composition.

4. The method according to claim 1, wherein the refrigerant system has a design refrigerant, and wherein the volatile composition is the design refrigerant.

5. The method according to claim 1, further comprising the step of adding a lubricant to the volatile composition.

6. The method according to claim 1, wherein the refrigeration system comprises a compressor, wherein the step of passing the purified volatile composition through the refrigerant system comprises bypassing the compressor.

7. The method according to claim 1, further comprising the step of controlling said purification based on a composition of received volatile composition from the refrigerant system.

8. The method according to claim 1, wherein the aqueous solvent is hot water.

9. The method according to claim 1, wherein the aqueous solvent is heated.

10. The method according to claim 9, wherein heat from the flushed aqueous solvent is extracted.

11. The method according to claim 1, wherein said drying step comprises flushing the portion of the refrigeration system with a continuously purified volatile composition.

12. The method according to claim 1, wherein said first phase continues at least until a nonvolatile reside in the flushed volatile composition falls below a threshold.

13. The method according to claim 1, wherein the second phase continues at least until an ion concentration falls below a threshold.

14. The method according to claim 11, wherein the drying continues until a residual water concentration falls below a threshold.

15. A method for drying a refrigeration system comprising providing a source of dry volatile composition to a refrigerant system; passing the dry volatile composition through the refrigerant system; receiving the volatile composition from the refrigerant system; drying the volatile composition; and reintroducing the dry volatile composition into the refrigerant system; and controlling said providing based on a composition of received volatile composition from the refrigerant system.

16. The method according to claim 15, wherein said removing water step comprises a fractional distillation.

17. The method according to claim 15, wherein the volatile composition comprises R-22.

18. The method according to claim 15, further comprising the step of operating a system valve while passing the dry volatile composition through the refrigerant system.

19. The method according to claim 15, wherein the volatile composition comprises a liquid fluorinated organic composition in which water is soluble.

20. The method according to claim 15, wherein the volatile composition comprises one or more refrigerants selected from the group consisting of R-11, R-12, R-22, R-113, R-114, R-123, R-134a, R-500, and R-502.

21. The method according to claim 15, wherein said removing water step comprises a dessicant.

22. The method according to claim 15, wherein said removing water step comprises a molecular sieve.

* * * * *